US008492691B1

(12) United States Patent
Hernandez

(10) Patent No.: US 8,492,691 B1
(45) Date of Patent: Jul. 23, 2013

(54) PORTABLE CONTAINER FOR STEAMING FOOD IN THE MICROWAVE

(76) Inventor: Sonia Corella Hernandez, Chandler, AZ (US)

( * ) Notice: Subject to any disclaimer, the term of this patent is extended or adjusted under 35 U.S.C. 154(b) by 281 days.

(21) Appl. No.: 12/806,972

(22) Filed: Aug. 25, 2010

Related U.S. Application Data

(60) Provisional application No. 61/276,720, filed on Sep. 16, 2009.

(51) Int. Cl.
*H05B 6/80* (2006.01)

(52) U.S. Cl.
USPC ..... 219/732; 219/682; 219/731; 219/735

(58) Field of Classification Search
USPC ..... 219/682, 731, 734, 735
See application file for complete search history.

(56) References Cited

U.S. PATENT DOCUMENTS

| | | | | |
|---|---|---|---|---|
| 5,097,753 | A | 3/1992 | Naft | 99/341 |
| 5,756,976 | A | 5/1998 | Akasaka | 219/732 |
| 5,931,333 | A | 8/1999 | Woodnorth | 220/573.4 |
| 6,325,234 | B1 * | 12/2001 | Legaspi | 220/367.1 |
| 7,030,346 | B1 | 4/2006 | Miao | 219/731 |
| 7,090,090 | B2 | 8/2006 | Ohyama | 220/367.1 |

FOREIGN PATENT DOCUMENTS

| | | | |
|---|---|---|---|
| JP | 9-56599 | * | 3/1997 |

* cited by examiner

*Primary Examiner* — A. Sefer
(74) *Attorney, Agent, or Firm* — Snell & Wilmer L.L.P.

(57) ABSTRACT

A portable and microwave safe container for steaming food. The container includes a lid, having an upper and lower portion, for coupling over a substantially circular food chamber. The upper and lower lid portions are connected together for holding water and creating steam therebetween when microwaved. The lower lid portion includes a middle portion and an outwardly extending sloped channel for holding water therein. The middle portion includes a plurality of steam holes for allowing steam to escape after the water is heated and move into the food chamber for heating the food contained therein. The food chamber has a lip for allowing the lower lid portion to securely rest thereon and cover the food chamber. A pivoting handle is affixed to the lid for locking the lid to the food chamber.

7 Claims, 2 Drawing Sheets

PORTABLE CONTAINER FOR STEAMING FOOD IN THE MICROWAVE

CROSS-REFERENCE TO RELATED APPLICATION

This application claims the benefit of provisional patent application Ser. No. 61/276,720, filed in the United States Patent Office on Sep. 16, 2009.

BACKGROUND OF THE INVENTION

1. Field of the Invention

The present invention relates to microwavable containers, and more specifically, to portable containers capable of utilizing steam to cook food in the microwave and maintain heat and freshness of the food when moving the container from the microwave to a desired location.

Throughout human history, societies have consistently advanced how they cook food. From spokes and fire pits, to microwaves and toaster ovens, each advancement in preparing and cooking food helps simplify and expedite the cooking process. Today, cooking food through the use of a microwave has become exceedingly more commonplace for the average household. The use of a microwave allows for a large quantity of food to be cooked in a relatively short period of time. In fact, many people cook entire meals using only the microwave.

As with most new technology, the microwave is not free of all flaws. With faster cooking speeds and the use of energy waves to heat meals, new areas of concern for the avid chef may arise. Often when food is cooked using a microwave in a regular container, the food looses dramatic amounts of heat as soon as it is taken out of the microwave and is not cooked through evenly. Similarly, such food often seems to arrive on the dinner table or at an event less fresh than when using a conventional oven. When food tends to cool too quickly, the food can take on an unappetizing "rubbery" texture. The present invention attempts to relieve this problem by utilizing steam to keep food both warm and fresh for an extended period of time after being taken out of the microwave.

Many individuals also do not cook in the microwave because they believe that healthy food cannot be produced through this method of cooking. The microwave is often used for cooking quick processed, pre-packaged meals and therefore is categorized in an unfair classification as a machine that only yields junk food. However, the present invention allows individuals to make healthy and wholesome meals through the use of steam. Like through stovetop cooking, the present invention can steam fresh vegetables and a wide variety of healthy alternatives.

The present invention seeks to resolve the foregoing issues at once, requiring no more effort on the part of the user than simply adding water to the microwavable container and cooking food held within the container using a microwave.

2. Description of the Related Art

U.S. Pat. No. 5,931,333 to Woodnorth et al. discloses a microwave steamer used for steaming food in the microwave. The food is placed in a slotted colander, which is then placed inside an outer container. As the food is heated in the container, liquid drips from the colander and into the outer container. The lid further contains a vent cap to prevent a pressure build up within the container.

U.S. Pat. No. 5,097,753 to Naft discloses a steam cooking utensil, in which a user places liquid in a boiling liquid reservoir, and an attached heater warms the liquid. The steam generated by the heating of the liquid flows into the cooking bowl through vent holes, causing the food in the cooking bowl to cook.

U.S. Pat. No. 5,756,976 to Akasaka discloses a microwavable tortilla bowl making device including an exterior rounded bowl portion having a plurality of vertically disposed slots therethrough in a spaced relationship. The exterior rounded bowl portion receives a flat tortilla therein. An interior rounded bowl portion is dimensioned for positioning within the exterior rounded bowl portion. The interior rounded bowl portion has a plurality of vertically disposed slots therethrough in a spaced relationship. The interior rounded bowl portion is positioned over the flat tortilla within the exterior rounded bowl portion whereby the flat tortilla conforms into a bowl-shape.

U.S. Pat. No. 7,030,346 to Leung discloses a moisture-adding microwave food cover apparatus, comprising of a capped (not absolutely essential, but part of the current implementation of the design) conical or dome-like structure, with an upper liquid reservoir, cool fin handle, removable top center cap, and a lower condensed moisture reservoir. The apparatus may be manufactured from any microwaveable material and it is efficient in preventing spatter, retaining heat, retaining moisture, and adding moisture to food that is heated or cooked using a microwave oven. The apparatus is easy to use, easy to clean, easy to manufacture, and reduces the time required to cook or heat food in a microwave.

United States Published Application 2004/0188442 to Ohyama was disclosed and reviewed.

While these units may be suitable for the particular purpose employed, or for general use, they would not be as suitable for the purposes of the present invention as disclosed hereafter.

SUMMARY OF THE INVENTION

It is an object of the invention to provide a container that heats food in the microwave by utilizing steam. Accordingly, the present invention is a container for steaming food in the microwave which includes a lid with an upper portion and a lower portion. Between the upper portion and the lower portion water is held so that when the container is put in the microwave, the water forms steam thereby cooking the food within the container.

It is another object of the invention to provide a container that keeps food warm once it is taken out of the microwave. Accordingly, between the upper portion and the lower portion of the lid of the present invention the steam is contained which allows food to maintain heat for an extended period of time once the container is removed from the microwave.

It is another object of the invention to provide a device that is microwave safe. Accordingly, the present invention is made completely of microwave safe material that will not melt or release toxins when in use.

It is another object of the invention to provide a device for steaming food in the microwave that is easy to use. Accordingly, the present invention merely requires the user to put water in the lower portion of the lid and secure the lower portion to the upper portion of the lid before microwaving.

It is yet another object of the invention to provide a means for retaining the steam that is created during microwaving. Accordingly, the lid of the present invention is completely sealed during use so that steam is unable to escape the container.

It is another object of the invention to provide a container that is portable. Accordingly, the present invention includes a pivoting handle for easily transporting the container from the microwave to another location while still retaining steam and maintaining heat so that the food remains warm during transportation.

The invention is a portable and microwave safe container for steaming food. The container includes a lid, having an upper and lower portion, for coupling over a substantially circular food chamber. The upper and lower lid portions are connected together for holding water and creating steam therebetween when microwaved. The lower lid portion includes a middle portion and an outwardly extending sloped channel for holding water therein. The middle portion includes a plurality of steam holes for allowing steam to escape after the water is heated and move into the food chamber for heating the food contained therein. The food chamber has a lip for allowing the lower lid portion to securely rest thereon and cover the food chamber. A pivoting handle is affixed to the lid for locking the lid to the food chamber.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
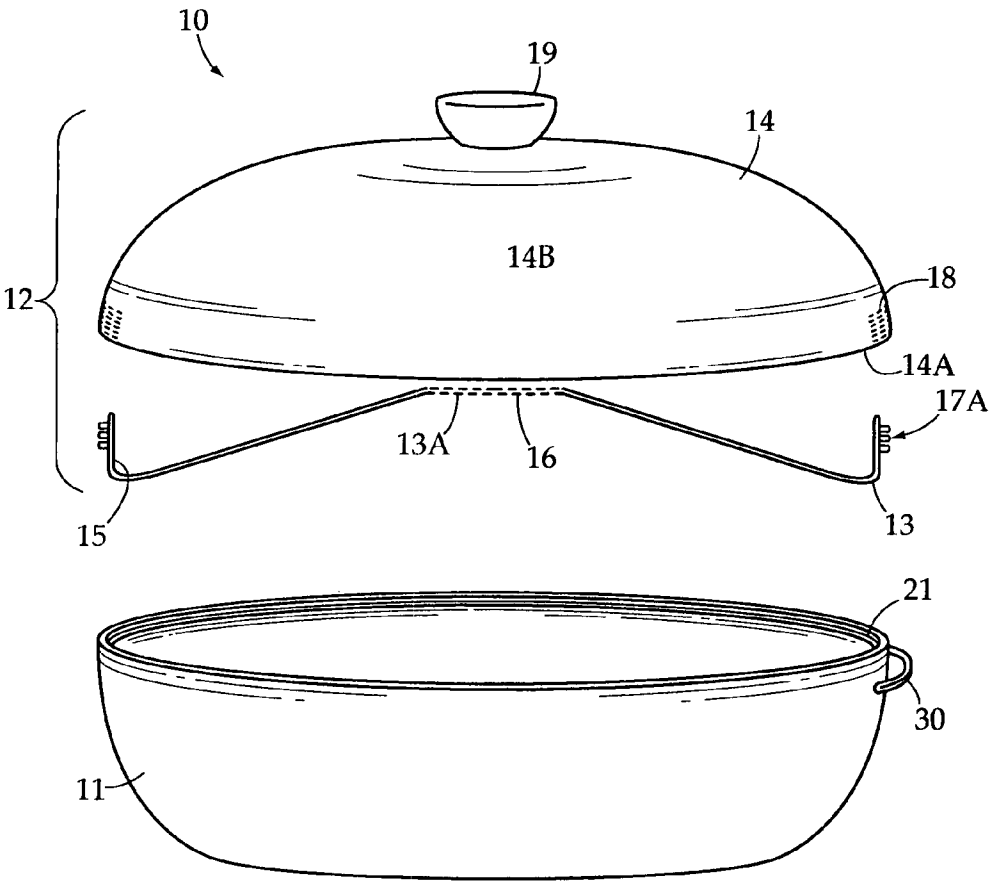
FIG. 1 is a front plan view of the portable container of the present invention, having a lid, including an upper and lower lid portion for holding water and creating steam there between, and a bottom food portion.

FIG. 1 illustrates a portable container 10, for use in a microwave, steaming and warming food products. The container 10 is composed of a food chamber 11 and a lid 12. The food chamber 11 and lid 12 of the container 10 are entirely made of a microwave safe material, and in a preferred embodiment they are made of glazed food grade ceramic material. The lid 12 consists of two separate pieces, a lower lid portion 13 and an upper lid portion 14 that are capable of being connected, wherein said lower lid portion 13 fits underneath and within said upper lid portion 14. In the preferred embodiment, the lower lid portion 13 and upper lid portion 14 are screwed together, or otherwise locked, affixed or coupled. The bottom food chamber 11 is a substantially circular large and shallow bowl wherein food is placed, cooked and stored therein and is then covered by use of the lid 12. In a preferred embodiment the chamber 11 and lid 12 are substantially circular or oval, however, in alternate embodiments other shapes are contemplated.

The upper lid portion 14 includes an inside surface 14A and an outside surface 14B. Preferably, the upper lid portion 14 is domed shaped and the outside surface 14B includes a top knob 19 centrally positioned thereon for removing the lid 12 off of the food chamber 11 as selectively desired.

In one embodiment, the inside surface 14A of the upper lid portion 14 includes a threaded surface 18 for securing the upper lid portion 14 to the lower lid portion 13.

The lower lid portion 13 is a substantially circular plate which includes a middle portion 13A and an outwardly extending sloped channel 15. The middle portion 13A includes at least one steam hole 16, preferably a plurality of steam holes, centrally positioned thereon for allowing steam to escape.

Figure 2:
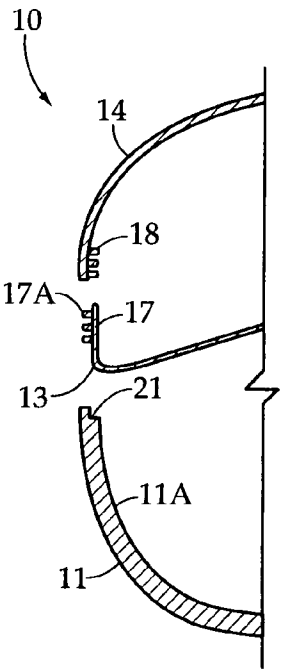
FIG. 2 is a partial cross-sectional view of the container of the present invention, illustrating the coupling of the lower lid portion to the upper lid portion, and the lower lid portion to the food chamber.

FIG. 2 illustrates the coupling of the lower lid portion 13 to the upper lid portion 14, and the lower lid portion 13 to the food chamber 11. The lower lid portion 13 has an integrally coupled upwardly extending flange 17 which extends upwardly at approximately a ninety degree angle from the sloped channel 15 for holding water therein. It is contemplated that the flange 17 includes a plurality of outwardly extending threads 17A for screwing within the threaded surface 18 of the upper lid portion 14.

As illustrated in FIG. 2, the bottom food chamber 11 includes an inside portion 11A having an outwardly extending lip 21. The flange 17 of the lower lid portion 13 is accepted for resting on the lip 21 of the bottom food chamber 11, for securing the lid 12 in position covering the chamber 11.

In alternate embodiments, it is contemplated that the food chamber 11 has at least one handle 30, shown in FIG. 1, for allowing a user to easily transport the container 10 from microwave to serving.

Figure 3:
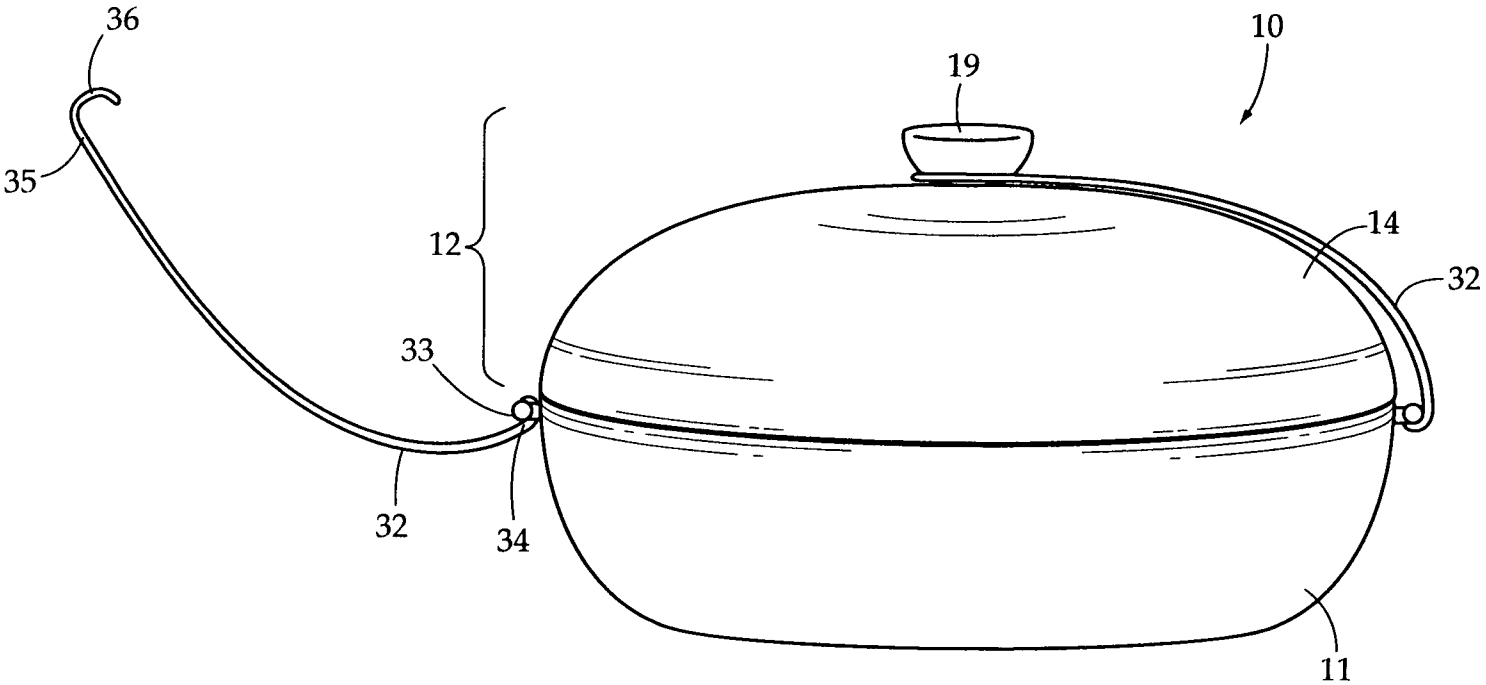
FIG. 3 is a perspective view of the container of the present invention, wherein the lid is covering the food chamber and the pivoting handles are illustrated locking the lid to the food chamber.

FIG. 3 illustrates an alternate embodiment in which the food chamber 11 includes a pair of pivoting handles 32, which securely lock the food chamber 11 to the lid 12. This thereby allows the user to transport the container 10, without worrying that the lid 12 may separate or slide off of the food chamber 11. Preferably, the pivoting handles 32, are elongated hinged members coupling via a hinge 33 to the bottom food chamber 11. Specifically, the handles 32 each include a first end 34 and a second end 35, wherein each first end connects via a hinge 33 to the bottom food chamber 11. The second ends 35 each include a locking member 36, which when in use secures the handle over the lid 12 and locks onto the top knob 19 of the upper lid portion 14 of the lid 12.

In use, water is first placed in the sloped channel 15 of the lower lid portion 13. Next, the lower lid portion 13 is coupled and accepted into position underneath the upper lid portion 14. In a preferred embodiment, the threaded surface 18 of the upper lid portion 14 is screwed or fastened into position with the threads 17A of the flange 17 of the lower lid portion 13. Food is then placed within the inside 11A of the food chamber 11. The lid 12, including both portions 13 and 14, is set on top of and covering the food chamber 11, such that the lid 12 rests within the lip 21 of the food chamber 11. The user takes the container 10, with food therein, and microwaves for a desired amount of time. The microwave heats the water contained within the sloped channel 15 of the lower lid portion 13 creating steam within the lid 12 between the upper and lower portions 14 and 13. The steam flows through the steam holes 16 in the middle portion 13A of the lower lid portion 13 and into the food chamber 11. During this process, food products contained within the food chamber 11 are steamed and warmed.

Additionally, because the steam is contained within the container 10, a user can remove the container 10 from the microwave and the food retains hot and warmth until being served, and thereby maintains its freshness for a much greater length of time. Thus, a user could move the container 10 to another location (i.e. another room in the home, or bring it to a function or event), and when the lid is removed the food is still warm and tastes fresh.

In conclusion, herein is presented a microwave safe container that allows a user to cook food with steam heat, the container being portable such that the food can be moved to a desired location. The invention is illustrated by example in the drawing figures, and throughout the written description. It should be understood that numerous variations are possible, while adhering to the inventive concept. Such variations are contemplated as being a part of the present invention.

What is claimed is:

1. A portable container comprising:

a bottom food chamber having an inside portion, said inside portion having an outwardly extending lip; and a lid comprising an upper lid portion and a lower lid portion, said upper lid portion having an inside surface and an outside surface, said inside surface having a threaded surface, wherein said lower lid portion having a middle portion and an outwardly extending sloped channel and an integrally coupled flange, said middle portion having a plurality of steam holes centrally positioned thereon, said flange extending upwardly from said sloped channel, said flange having a plurality of outwardly extending threads for interlocking and securing with said threaded surface of said upper lid portion for securing said upper lid portion to said lower lid portion by said lower lid portion fitting underneath and within said upper lid portion, said flange accepting and resting along said lip of said bottom food chamber.

2. The portable container of claim 1, further comprising at least one handle in connection with said food chamber.

3. The portable container of claim 2, having a pair of pivoting handles connecting to said bottom food chamber opposite one another, wherein said pivoting handles are elongated hinged members each having a first end and a second end, each first end connecting via said hinge to said bottom food chamber, each said second end including a locking member for securing said handle over said lid and locking onto a top knob centrally positioned on said outside surface of said upper lid portion of said lid.

4. The portable container of claim 1, wherein said flange extends upwardly at a ninety degree angle from said sloped channel.

5. The portable container of claim 1, wherein said outside surface of said upper lid has a top knob centrally positioned thereon.

6. A portable container comprising:

a bottom food chamber having an inside portion, said inside portion having an outwardly extending lip; and a lid comprising an upper lid portion and a lower lid portion, said upper lid portion having an inside surface and an outside surface, wherein said lower lid portion having a middle portion and an outwardly extending sloped channel and an integrally coupled flange, wherein said lower lid portion and said upper lid portion defining an upper space configured to hold water and steam, wherein said lower lid portion and said bottom food chamber defining a lower space configured to contain food, wherein said middle portion having a plurality of steam holes centrally positioned thereon passing through the middle portion configured to allow steam to pass from said upper portion to said lower portion, wherein said flange extending upwardly from said sloped channel, an exterior surface of said flange securing with said inside surface of said upper lid portion and said lower lid portion fitting underneath and within said upper lid portion.

7. The portable container of claim 6, wherein said inside surface of the upper lid potion has a threaded surface and said flange has a plurality of outwardly extending threads for interlocking and securing with said threaded surface of said upper lid portion for securing said upper lid portion to said lower lid portion, wherein said lower lid portion fitting underneath and within said upper lid portion, said flange accepting and resting along said lip of said bottom food chamber.

* * * * *